US011077660B2

(12) United States Patent
Mizuno

(10) Patent No.: US 11,077,660 B2
(45) Date of Patent: Aug. 3, 2021

(54) LIQUID DISCHARGE HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/709,211

(22) Filed: Dec. 10, 2019

(65) Prior Publication Data

US 2020/0247120 A1 Aug. 6, 2020

(30) Foreign Application Priority Data

Jan. 31, 2019 (JP) ..... JP2019-015392

(51) Int. Cl.

| | |
|---|---|
| ***B41J 2/14*** | (2006.01) |
| ***B41J 2/18*** | (2006.01) |
| *B41J 3/54* | (2006.01) |
| *B41J 2/055* | (2006.01) |

(52) U.S. Cl.

CPC ..... *B41J 2/14233* (2013.01); *B41J 2/18* (2013.01); *B41J 2/055* (2013.01); *B41J 2/1404* (2013.01); *B41J 3/543* (2013.01); *B41J 2002/14241* (2013.01); *B41J 2002/14338* (2013.01); *B41J 2002/14419* (2013.01); *B41J 2202/11* (2013.01); *B41J 2202/12* (2013.01)

(58) Field of Classification Search

CPC ..... B41J 2/14233; B41J 2002/14419; B41J 2202/11; B41J 2202/12; B41J 2002/14241

See application file for complete search history.

(56) References Cited

U.S. PATENT DOCUMENTS 9,827,778 B2 * 11/2017 Ishikawa ..... B41J 2/14233
2018/0272697 A1 9/2018 Chikamoto et al.

FOREIGN PATENT DOCUMENTS

JP 2018-158536 A 10/2018

* cited by examiner

*Primary Examiner* — Geoffrey S Mruk
(74) *Attorney, Agent, or Firm* — Banner & Witcoff, Ltd.

(57) ABSTRACT

There is provided a liquid discharge head including: a plurality of pressure chambers including pressure chambers aligned in a first direction orthogonal to a vertical direction so as to form a first pressure chamber group, and pressure chambers aligned in the first direction so as to form a second pressure chamber group arranged side to side relative to the first pressure chamber group in a second direction; a return channel extending in the first direction; and return connecting channels each connecting the return channel and one of the plurality of pressure chambers to each other, wherein a height of an upper surface of each of the return connecting channels is not less than a height of an upper surface of one of the plurality of pressure chambers which is connected to the return channel by each of the return connecting channels.

15 Claims, 6 Drawing Sheets

LIQUID DISCHARGE HEAD

CROSS REFERENCE TO RELATED APPLICATION

The present application claims priority from Japanese Patent Application No. 2019-015392 filed on Jan. 31, 2019, the disclosure of which is incorporated herein by reference in its entirety.

BACKGROUND

Field of the Invention

The present disclosure relates to a liquid discharge head provided with two pressure chamber groups, and a return channel provided between pressure chambers included in the two pressure chamber groups.

Description of the Related Art

There is a publicly known liquid discharge head provided with two pressure chamber groups, and a return channel provided between pressure chambers of the two pressure chamber groups. This publicly known liquid discharge head is provided with return connecting channels which are provided for the pressure chambers, respectively, and each of which connects one of the pressure chambers to the return channel.

In the above-described liquid discharge head, the height of an upper surface of each of the return connecting channels is lower than the height of an upper surface of one of the pressure chambers. In this configuration, in a case that the liquid flows from each of the pressure chambers to the return channel via one of the return connecting channels, any air bubble(s) in the liquid might be caught at any stepped portion between the upper surface of each of the pressure chambers and the upper surface of one of the return connecting channels, and might remain inside each of the pressure chambers.

An object of the present disclosure is to provide a liquid discharge head capable of suppressing the problem of the air bubble(s) remaining inside the pressure chamber.

SUMMARY

According to an aspect of the present disclosure, there is provided a liquid discharge head including: a plurality of pressure chambers forming a first pressure chamber group and a second pressure chamber group, the first pressure chamber group including a part of the pressure chambers aligned in a first direction orthogonal to a vertical direction, and the second pressure chamber group including another part of the pressure chambers aligned in the first direction, the second pressure chamber group being arranged side by side relative to the first pressure chamber group in a second direction orthogonal to the vertical direction and crossing the first direction; a return channel extending in the first direction between, in the second direction, the pressure chambers included in the first pressure chamber group and the pressure chambers included in the second pressure chamber group; and a plurality of return connecting channels each connecting the return channel and one of the plurality of pressure chambers to each other. A height of an upper surface of each of the plurality of return connecting channels is not less than a height of an upper surface of one of the plurality of pressure chambers which is connected to the return channel by each of the plurality of return connecting channels.

DESCRIPTION OF THE EMBODIMENTS

First Embodiment

Figure 1:
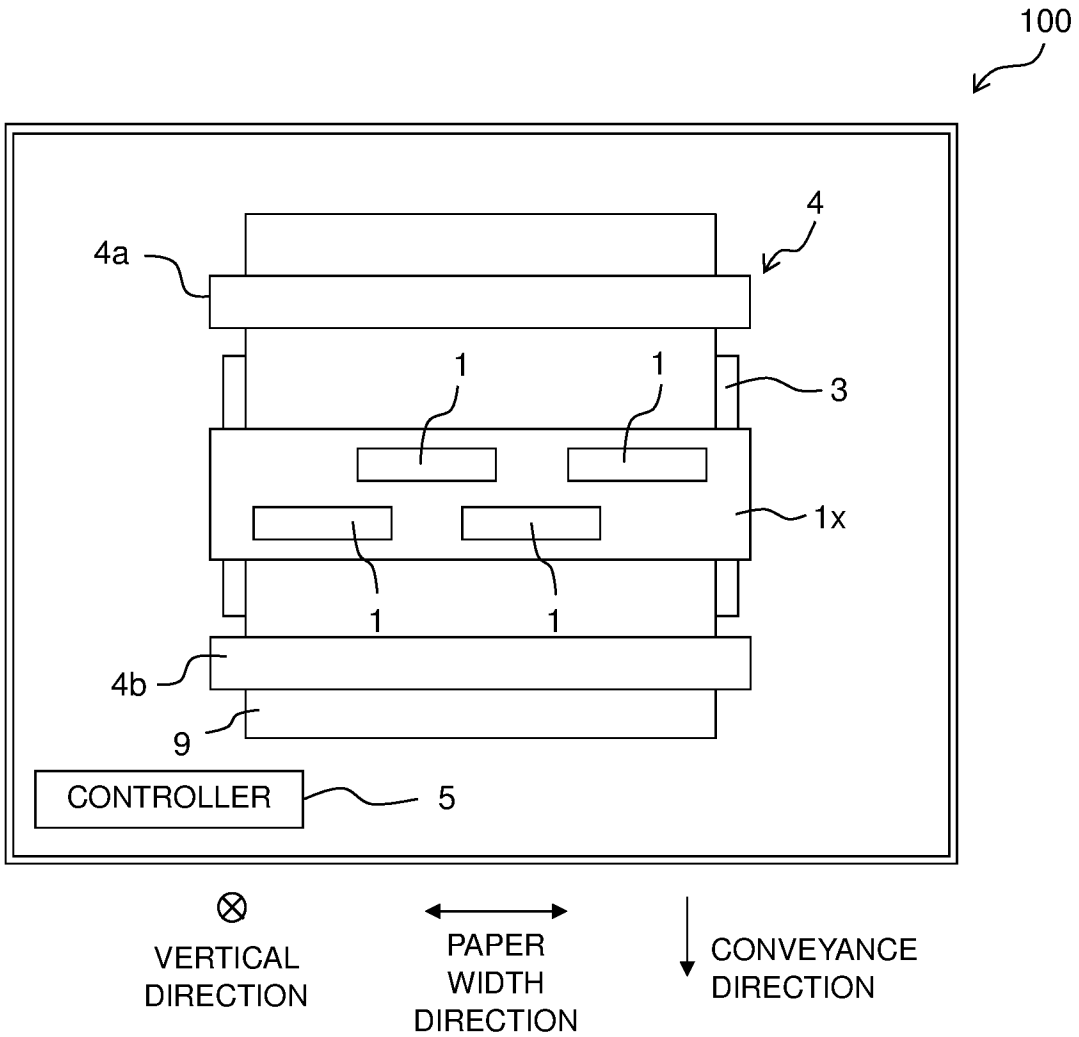
FIG. 1 is a plan view depicting a printer 100 provided with a head 1.

At first, the overall configuration of a printer 100 provided with a head 1 according to a first embodiment of the present disclosure will be explained, with reference to FIG. 1.

The printer 100 is provided with a head unit 1X including four heads 1, a platen 3, a conveying mechanism 4, and a controller 5.

A paper sheet (sheet) 9 is placed on the upper surface of the platen 3.

The conveying mechanism 4 has a pair of two conveying rollers 4*a* and 4*b* arranged side by side in a conveyance direction, with the platen 3 being sandwiched between the pair of conveying rollers 4*a* and 4*b* in a conveyance direction. In a case that a conveying motor 4*m* (see FIG. 4) is driven by control performed by the controller 5, the pair of conveying rollers 4*a* and 4*b* are rotated in a state that the pair of conveying rollers 4*a* and 4*b* sandwich or pinch the paper sheet 9 therebetween, to thereby convey the paper sheet 9 in the conveyance direction.

The head unit 1*x* is elongated in a paper width direction (which is a direction orthogonal to both of the conveying direction and a vertical direction); the head unit 1*x* is a line head which discharges or jets an ink from nozzles 21 (see FIGS. 2 and 3) toward the paper sheet 9 in a state that the position of the head unit 1*x* is fixed. The four heads 1 are arranged in the paper width direction in a staggered manner.

The controller 5 has a ROM (Read Only Memory), a RAM (Random Access Memory), and an ASIC (Application Specific Integrated Circuit). The ASIC executes a recording processing, etc., based on a program stored in the ROM. In the recording processing, the controller 5 controls a driver IC 1*d* of each of the heads 1 and a conveying motor 4*m* (see FIG. 4 for both of the driver IC 1*d* and the conveying motor 4*m*), based on a recording instruction (including image data) inputted from an external apparatus or device such as a PC, etc., to thereby record an image on the paper sheet 9.

Next, the configuration of each of the heads 1 will be explained, with reference to FIGS. 2 and 3.

Figure 3:
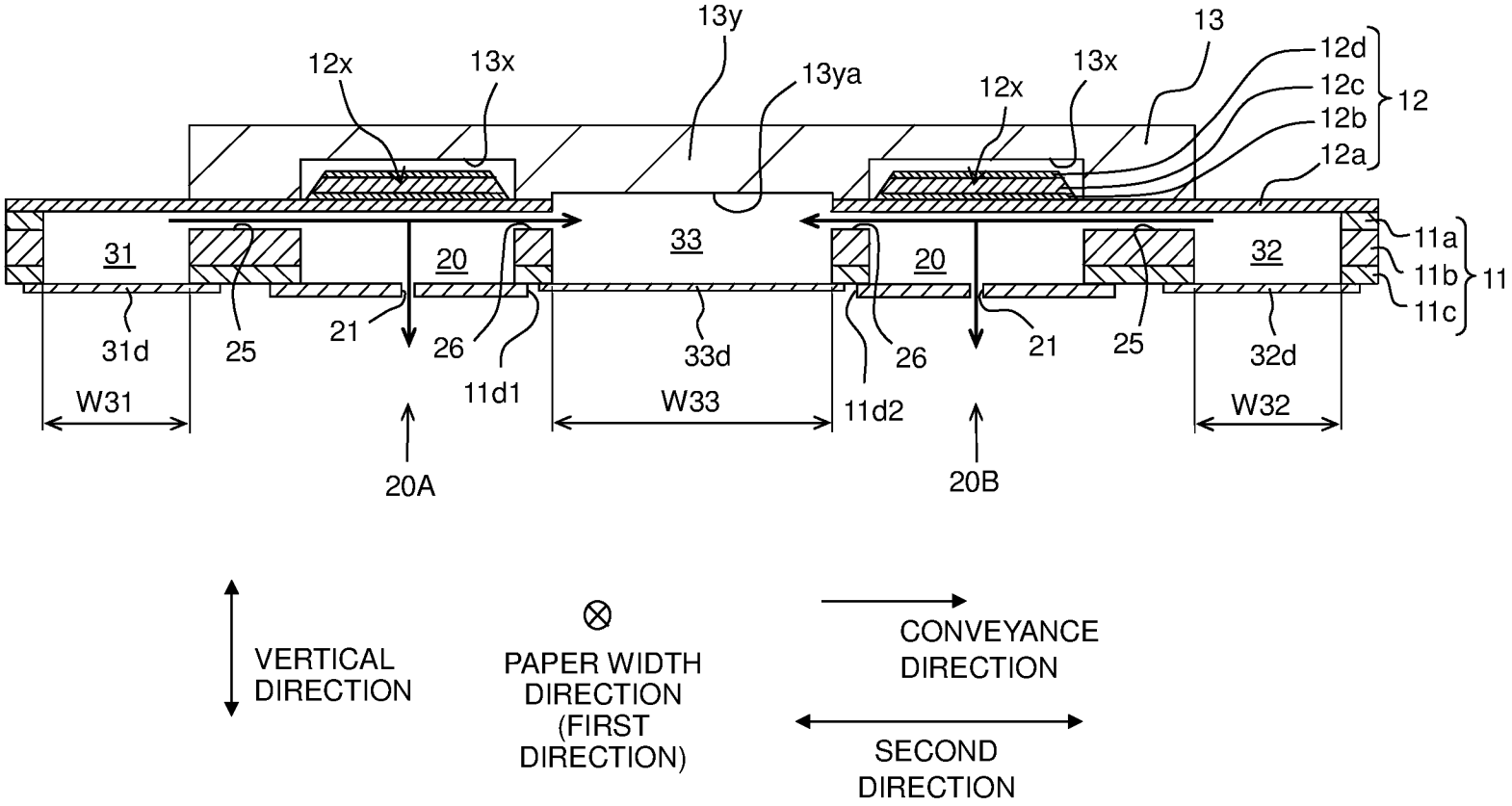
FIG. 3 is a cross-sectional view of the head 1, as taken along a III-III line in FIG. 2.

As depicted in FIG. 3, each of the heads 1 has a channel substrate 11, an actuator substrate 12 which is fixed to the upper surface of the channel substrate 11, and a protective substrate 13 which covers a plurality of actuators 12*x* provided on the actuator substrate 12.

The channel substrate 11 is formed with a first supply channel 31, a second supply channel 32, a return channel 33, a plurality of pressure chambers 20, a plurality of supply connecting channels 25, a plurality of return connecting channels 26 and a plurality of nozzles 21.

Figure 2:
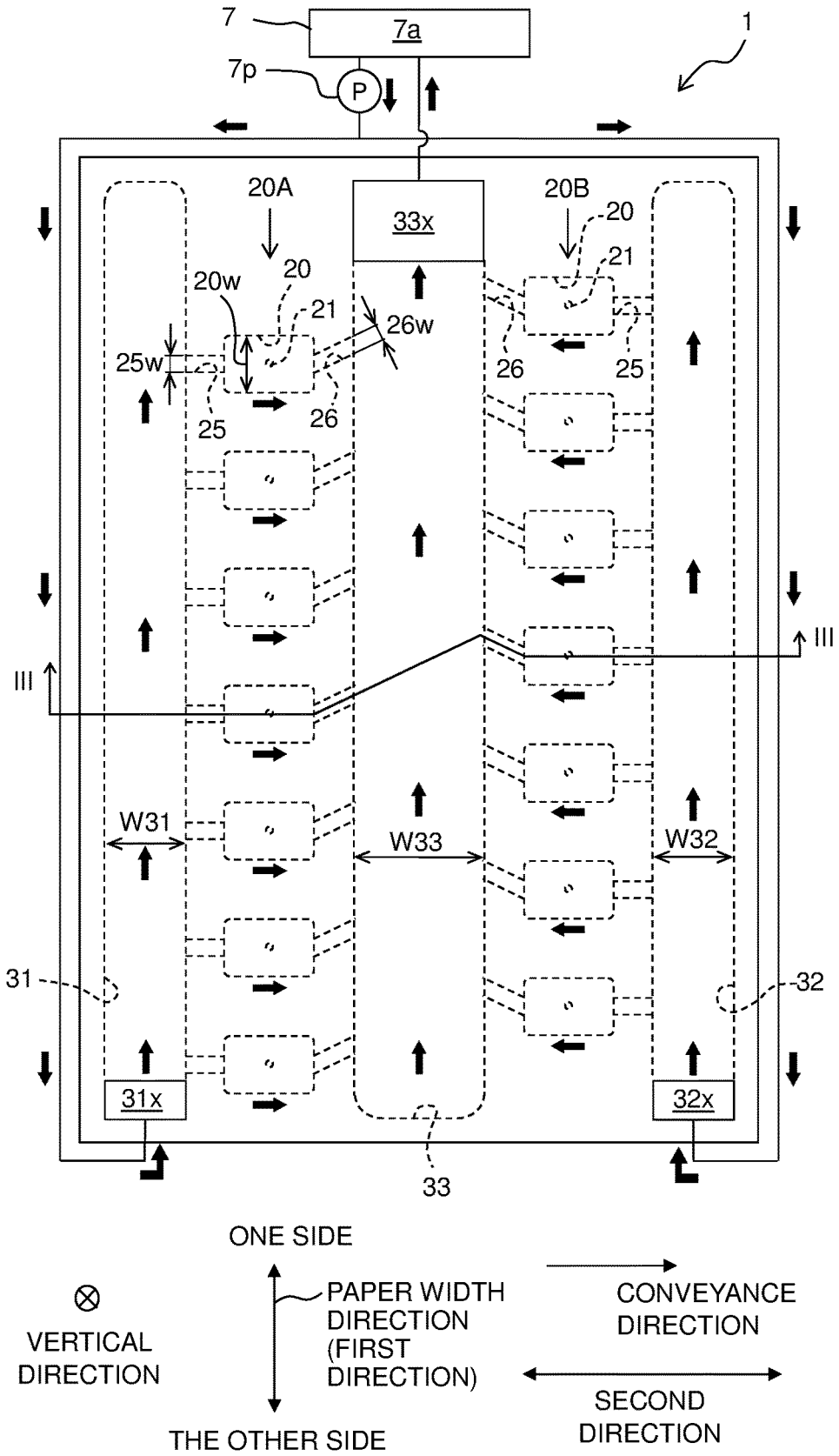
FIG. 2 is a plan view of the head 1.

The plurality of pressure chambers 20 are arranged (aligned) in a staggered manner in the paper width direction (first direction) as depicted in FIG. 2, and construct a first pressure chamber group 20A and a second pressure chamber group 20B. The first pressure chamber group 20A and the second pressure chamber group 20B are arranged side by side in a second direction parallel to the conveyance direction, and each of the first pressure chamber group 20A and the second pressure chamber group 20B is constructed of pressure chambers 20 included in the plurality of pressure chambers 20 and aligned side by side in the first direction to form a row (array) at an equal spacing distance therebetween.

The first supply channel 31, the second supply channel 32 and the return channel 33 each extend in the first direction. The return channel 33 is arranged between the first supply channel 31 and the second supply channel 32, in the second direction. The pressure chambers 20 included in the plurality of pressure chambers 20 and belonging to the first pressure chamber group 20A are arranged between the first supply channel 31 and the return channel 33 in the second direction. The pressure chambers 20 included in the plurality of pressure chambers 20 and belonging to the second pressure chamber group 20A are arranged between the return channel 33 and the second supply channel 32 in the second direction. In the second direction, the return channel 33 is arranged between the pressure chambers 20 included in the plurality of pressure chambers 20 and belonging to the first pressure chamber group 20A and the pressure chambers 20 included in the plurality of pressure chambers 20 and belonging to the second pressure chamber group 20A.

A width W33 of the return channel 33 is greater than any one of a width W31 of the first supply channel 31 and a width W32 of the second supply channel 32. The width W31 of the first supply channel 31 and the width W32 of the second supply channel 32 are same to each other (mutually same). This configuration is made while considering that the number of the pressure chambers 20 communicating with the return channel 33 is twice the numbers of the pressure chambers 20 communicating with each of the first and second supply channels 31 and 32; and that an amount of the ink flowing through the return channel 33 is twice an amount of the ink flowing through each of the first and second supply channels 31 and 32.

The first supply channel 31 and the second supply channel 32 are communicated with a storage chamber 7*a* of a subs tank 7 via a supply port 31*x* and a supply port 32*x*, respectively. The return channel 33 is communicated with the storage chamber 7*a* via a return port 33*x*. The supply ports 31*x* and 32*x* are formed in end parts, respectively, on one side in the first direction (lower side in FIG. 2) of the first and second supply channels 31 and 32, respectively. The return port 33*x* is formed in an end part on the other side in the first direction (upper side in FIG. 2) of the return channel 33.

The storage chamber 7*a* is communicated with a main tank (not depicted in the drawings) configured to store an ink, and stores the ink supplied from the main tank.

Each of the plurality of pressure chambers 20 has a substantially rectangular shape which is elongated in the second direction, in a plane orthogonal to the vertical direction. One of the plurality of nozzles 21 is formed in a substantially central part, of each of the plurality of pressure chambers 20A, in this plane. Further, one of the plurality of supply connecting channels 25 and one of the plurality of return connecting channels 26 are connected to one end and the other end in the second direction, respectively, of each of the plurality of pressure chambers 20.

Each of the plurality of supply connecting channels 25 connects one of the plurality of pressure chambers 20 and the first supply channel 31 or the second supply channel 32 to each other. Each of the return connecting channels 26 connects one of the plurality of pressure chambers 20 and the return channel 33 to each other. Each of the pressure chambers 20 included in the plurality of pressure chambers 20 and belonging to the first pressure chamber group 20A is communicated with the first supply channel 31 via one of the plurality of supply connecting channels 25. Each of the pressure chambers 20 included in the plurality of pressure chambers 20 and belonging to the second pressure chamber group 20B is communicated with the second supply channel 32 via one of the plurality of supply connecting channels 25. The pressure chambers 20 belonging to the first pressure chamber group 20A and the pressure chambers 20 belonging to the second pressure chamber group 20B are each communicated with the return channel 33 via the plurality of return connecting channels 26, respectively.

Here, each of the plurality of supply connecting channels 25 extends in the second direction, whereas each of the plurality of return connecting channels 26 extends in an oblique direction (a direction orthogonal to the vertical direction and crossing with respect to both of the first and second directions). Further, a width W25 of each of the supply connecting channels 25 and a width W26 of each of the return connecting channels 26 are smaller than a width W20 of each of the pressure chambers 20. The width W25 of the supply connecting channel 25 and the width W26 of the return connecting channel 26 are mutually same.

The channel substrate 11 has three plates 11*a*, 11*b* and 11*c*, and two nozzle plates 11*d*1 and 11*d*2, as depicted in FIG. 3.

The three plates 11*a*, 11*b* and 11*c* are stacked on top of one another in the vertical direction. The nozzle plates 11*d*1 and 11*d*2 are adhered to the plate 11*c* which is the lowermost layer among the three plates 11*a*, 11*b* and 11*c*. The nozzle plates 11*d*1 and 11*d*2 are separated from each other, and are each constructed of a plate having a substantially rectangular shape which extends in the first direction.

Each of the plurality of nozzles 21 is constructed of one of through holes formed in the nozzle plate 11*d*1 or 11*d*2, and is open in the lower surface of the channel substrate 11. The nozzle plate 11*d*1 is formed with nozzles 21 which are included in the plurality of nozzles 21 and which correspond respectively to the pressure chambers 20 belonging to the first pressure chamber group 20A. The nozzle plate 11*d*2 is formed with nozzles 21 which are included in the plurality of nozzles 21 and which correspond respectively to the pressure chambers 20 belonging to the second pressure chamber group 20B.

The actuator substrate 12 includes, in an order from the lower side, a vibration plate 12*a*, a common electrode 12*b*, a plurality of piezoelectric bodies 12*c* and a plurality of individual electrodes 12*d*.

The vibration plate 12*a* is arranged substantially on the entirety of the upper surface of the channel substrate 11, and covers all of the plurality of pressure chambers 20, the plurality of supply connecting channels 25, the plurality of return connecting channels 26, the first supply channel 31 and the second supply channel 32 which are formed in the channel substrate 11. The common electrode 12*b* and the plurality of piezoelectric bodies 12*c* are provided on each of the pressure chamber groups 20A and 20B, and are arranged so as to straddle over the pressure chambers 20 belonging to each of the pressure chamber groups 20A and 20B. The plurality of individual electrodes 12*d* are provided on the plurality of pressure chambers 20, respectively, and overlap with the plurality of pressure chambers 20, respectively, in the vertical direction.

Figure 4:
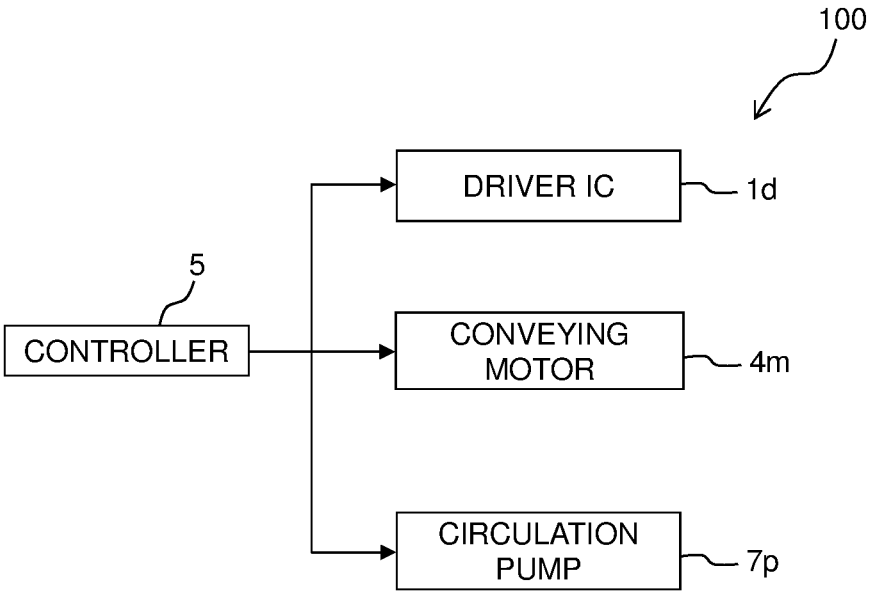
FIG. 4 is a block diagram depicting the electric configuration of the printer 100.

The common electrode 12*b* and the plurality of individual electrodes 12*d* are electrically connected to the driver IC 1*d* (see FIG. 4). The driver IC 1*d* maintains the potential of the common electrode 12*b* at the ground potential, whereas changes the potential of the plurality of individual electrodes 12*d*. Specifically, the driver IC 1*d* generates a driving signal based on a control signal from the controller 5, and applies the driving signal to a certain individual electrode 12*d* which is included in the plurality of individual electrodes 12*d*. With this, the potential of the certain individual electrode 12*d* changes between a predetermined driving potential and the ground potential. In this situation, parts (actuator 12*x*), of the vibration plate 12*a* and of the piezoelectric body 12*c*, respectively, which are sandwiched between the certain individual electrode 12*d* and a certain pressure chamber 20 included in the plurality of pressure chambers 20 and corresponding to the certain individual electrode 12*d* are deformed so as to project toward the certain pressure chamber 20, thereby changing the volume of the certain pressure chamber 20, applying pressure to the ink inside the certain pressure chamber 20 and thus discharging the ink from a certain nozzle 21 included in the plurality of nozzles 21 and corresponding to the certain pressure chamber 20. The actuator substrate 12 has a plurality of pieces of the actuator 12*x* at positions overlapping with the plurality of pressure chambers 20, respectively, in the vertical direction.

The protective substrate 13 is adhered to the upper surface of the vibration plate 12, and is arranged at a position at which the protective substrate 13 sandwiches the actuator substrate 12 in the vertical direction between the channel substrate 11 and the protective substrate 13. The protective substrate 13 is constructed of a material (Silicon, etc.) of which rigidity is higher than any one of the plates 11*a*, 11*b*, 11*c*, 11*d*1 and 11*d*2 constructing the channel substrate 11.

Two concave parts 13*x* are formed in the lower surface of the protective substrate 13. The two concave parts 13*x* each extend in the first direction; one of the two concave parts 13*x* overlaps, in the vertical direction, with the pressure chambers 20 belonging to the pressure chamber group 20A, and the other of the two concave parts 13*x* overlaps, in the vertical direction, with the pressure chambers 20 belonging to the pressure chamber group 20B. Actuators 12*x* which are included in the plurality of actuators 12*x* and which correspond to the pressure chamber group 20A and actuators 12*x* which are included in the plurality of actuators 12*x* and which correspond to the pressure chamber group 20B are accommodated or stored in the two concave parts, respectively.

In the lower surface of the protective substrate 13, a convex part 13*y* is formed at a location which is between the two concave parts 13*x* in the second direction. The convex part 13*y* extends in the first direction, and overlaps, in the vertical direction, with the returning channel 33 and the plurality of return connecting channels 26 corresponding to both of the first pressure chamber group 20A and the second pressure chamber group 20B.

In a part of the convex part 13*y* and a part of the vibration plate 12*a*, which overlap with the return channel 33 in the vertical direction, are subjected to cutting by means of an etching processing, etc. This cut part of the vibration plate 12*a* is formed with a through hole, and the cut part of the convex part 13*y* is formed with a recessed part 13*ya*.

For example, in a production step of the head 1, the vibration plate 12*a* is formed with a film of silicon dioxide by using, as the plate 11*a*, a substrate made of a silicon single crystal and by oxidizing a surface of the silicon single crystal substrate. Afterwards, through holes are formed in the silicon single crystal substrate and the vibration plate 12*a* at locations thereof, respectively, corresponding to the recessed part 13*ya*. Then, the common electrode 12*b* is formed on the vibration plate 12*a* present in the surface of the silicon single crystal substrate, the piezoelectric bodies 12*c* are formed on the common electrode 12*b*, and the individual electrodes 12*d* are formed on the piezoelectric bodies 12, respectively. Further, after forming a protective film and a wiring for the electrodes 12*a* and 12*b*, the protective substrate 13 having the recessed part 13*ya* previously formed therein by means of the etching processing, etc., is adhered to the vibration plate 12*a* arranged on the surface of the silicon single crystal substrate. Note that in a case of forming the recessed part 13*ya*, it is preferred that the depth (length in the vertical direction) of the recessed part 13*ya* is not too deep, so as to suppress any decrease in the rigidity of the protective substrate 13. For example, it is preferred to performing the cutting to form the recessed part 13*ya* so that the depth of the recessed part 13*ya* is not deeper than the depth (in a range of approximately 120 μm to approximately 30 μm) of the pressure chamber 20. Then, in a state that the surface, in the silicon single crystal substrate, formed with the vibration plate 12, is supported by the protective substrate 13, the back surface of the silicon single crystal substrate is polished until the silicon single crystal substrate has a predetermined thickness; and then through holes constructing the pressure chambers 20, etc., are formed by the etching processing, etc. With this, the plate 11*a* is completed, and the head 1 is completed by further adhering the plates 11*b*, 11*c*, 11*d*1 and 11*d*2 which have been subjected to the etching processing, etc., to the lower surface of the plate 11*a*.

The return channel 33 is constructed of the through holes formed in the plates 11*a*, 11*b* and 11*c*, the above-described through hole formed in the vibration plate 12, and the recessed part 13*ya* formed in the convex part 13*y*. The upper surface of the return channel 33 is defined by the bottom surface of the recessed part 13*ya* in the convex part 13*y*. The lower surface of the return channel 33 is defined by a return damper film 33*d*.

Each of the first supply channel 31 and the second supply channel 32 is constructed of through holes formed in the plates 11*a*, 11*b* and 11*c*, respectively. The upper surfaces of the first supply channel 31 and the second supply channel 32 are defined by the vibration plate 12. The bottom surface of the first supply channel 31 and the bottom surface of the second supply channel 32 are defined by a first supply damper film 31*d* and a second supply damper film 32*d*, respectively.

The return damper film 33*d* is located, in the second direction, between the nozzle plate 11*d*1 and the nozzle plate 11*d*2. The first supply damper film 31*d* and the second supply damper film 32*d* sandwich, in the second direction, the nozzle plates 11*d*1 and 11*d*2 and the return damper film 33*d* therebetween.

In the production step of the head 1, the nozzle plates 11*d*1 and 11*d*2 for which a high positional precision is required are firstly adhered to the lower surface of the plate 11*c*, and then the damper films 31*d*, 32*d* and 33*d* are adhered to the lower surface of the plate 11*c*.

The damper films 31*d*, 32*d* and 33*d* cover the entireties of the lower surfaces of the channels 31, 32 and 33, respectively. Here, since the width W33 of the return channel 33 is greater than any one of the width W31 of the first supply channel 31 and the width W32 of the second supply channel 32, a size (width) of the return damper film 33*d* is made greater than any one of a size (width) of the first supply damper film 31*d* and a size (width) of the second supply damper film 32*d*. Further, although the damper films 31*d*, 32*d* and 33*d* are formed of a same material (polyimide, etc.), the thickness of the return damper film 33*d* is smaller than any one of the thickness of the first supply damper film 31*d* and the thickness of the second supply damper film 32*d*. Therefore, the Young's module of the return damper film 33*d* is lower than any one of the Young's module of the first supply damper film 31*d* and the Young's module of the second supply damper film 32*d*.

Each of the plurality of pressure chambers 20 is constructed of through holes formed in the plates 11*a*, 11*b* and 11*c*, respectively. The upper surface of each of the plurality of pressure chambers 20 is defined by the vibration plate 12*a*. The lower surfaces of the pressure chambers 20 belonging to the first pressure chamber group 20A are defined by the nozzle plate 11*d*1. The lower surfaces of the pressure chambers 20 belonging to the first pressure chamber group 20B are defined by the nozzle plate 11*d*2.

The plurality of supply connecting channels 25 are defined by through holes, respectively, formed in the plate 11*a*. The upper surfaces of the plurality of supply connecting channels 25 are defined by the vibration plate 12*a*. The lower surfaces of the plurality of supply connecting channels 25 are defined by the plate 11*b*.

The plurality of return connecting channels 26 are defined by through holes, respectively, formed in the plate 11*a*. The upper surfaces of the plurality of return connecting channels 26 are defined by the vibration plate 12*a*. The lower surfaces of the plurality of return connecting channels 26 are defined by the plate 11*b*.

The heights of the upper surfaces are constant or uniform from each of the supply channels 31 and 32, the plurality of supply connecting channels 25, the pressure chambers 20 and up to the plurality of return connecting channels 26, whereas the height of the upper surface of the return channel 33 is made to be higher than the heights of the upper surfaces of the pressure chambers 20, etc.

The supply channels 31 and 32, and the pressure chambers 20 have depths (lengths in the vertical direction) which are same to one another (mutually same), and have the heights of the upper surfaces and the heights of the lower surfaces which are mutually same. The plurality of supply connecting channels 25 and the plurality of return connecting channels 26 have depths (lengths in the vertical direction) which are mutually same, have the depths which are smaller than those of the supply channels 31 and 32 and the pressure chambers 20, and the lower surfaces which are located at positions, respectively, higher than those of the supply channels 31 and 32 and the pressure chambers 20. The return channel 33 has a depth greater than those of the supply channels 31 and 32 and the pressure chamber 20, and the height of the lower surface of the return channel 33 is same to those of the supply channels 31 and 32 and the pressure chambers 20. The return channel 33, however, has a height of the upper surface which is higher than those of the supply channel 31 and 32 and the pressure chambers 20.

Each of the nozzles 21 is located immediately below one of the pressure chambers 20, and is provided on a part, in the lower surface of one of the pressure chambers 20 (in the present embodiment, each of the nozzles 21 is located at a central part in the second direction in the lower surface of one of the pressure chamber 20), which is separated away from an end in the second direction in the lower surface of one of the pressure chambers 20 (an end, in the second direction in the lower surface of one of the pressure chambers 20, to which each of the plurality of return connecting channels 26 is connected).

In a case that the ink is circulated between the sub tank 7 and the channel substrate 11 in the above-described channel configuration, the ink flows inside the channel substrate 11 in the following manner. Bold arrows in FIGS. 2 and 3 indicate flow of the ink during the circulation.

The circulation pump 7*p* is driven by the control performed by the controller 5, thereby causing the ink inside the storage chamber 7*a* to be supplied to the first supply channel 31 and the second supply channel 32 via the supply port 31*x* and the supply port 32*x*, respectively. The ink supplied to each of the supply channels 31 and 32 moves inside each of the supply channels 31 and 32 from one side (lower side in FIG. 2) toward the other side (upper side in FIG. 2) of the first direction, while passing through each of the plurality of supply connecting channels 25 and flowing into one of the pressure chambers 20. A part or portion of the ink inflowed into each of the pressure chambers 20 is discharged from one of the nozzles 21 and a remainder of the ink inflowed into each of the pressure chambers 20 passes through one of the plurality of return connecting channels 26 and flows into the return channel 33, as depicted in FIG. 3. The ink inflowed into the return channel 33 moves inside the return channel 33 from one side (lower side in FIG. 2) to toward the other side (upper side in FIG. 2) of the first direction, and is returned to the storage chamber 7*a* via the return port 33*x*.

By allowing the ink to circulate between the sub tank 7 and the channel substrate 11 in such a manner, it is possible to realize the removal of any air bubble(s) in the channel(s) formed in the channel substrate 11 and/or to prevent any increase in the viscosity of the ink in the channel(s) formed in the channel substrate 11. Further, in a case that the ink contains a sediment component (a component which might sediment or settle; a pigment, etc.), such a sediment component is agitated, which in turn prevents any sedimentation of the sediment component from occurring.

As described above, according to the present embodiment, the height of the upper surface of each of the plurality of return connecting channels 26 is not less than (in the present embodiment, at the same height as) the height of the upper surface of a pressure chamber 20 included in the plurality of pressure chambers 20 and corresponding thereto (a pressure chamber 20 included in the plurality of pressure chambers 20 and to which each of the plurality of return connecting channels 26 is connected; or a pressure chamber 20 included in the plurality of pressure chambers 20 and which is connected to the return channel 33 by each of the plurality of return connecting channels 26) (see FIG. 3). With this, any air bubble(s) inside the ink flows smoothly from the pressure chamber 20 toward the return connecting channel 26, without being caught by any stepped part or portion between the upper surface of the pressure chamber 20 and the upper surface of the return connecting channel 26. Accordingly, it is possible to suppress such a problem that the air bubble(s) remain inside the pressure chamber 20.

The height of the upper surface of the return channel 33 is higher than any of the heights of the upper surfaces of the plurality of pressure chambers 20 (see FIG. 3). In this case, it is possible to secure the volume of the return channel 33, and to easily retain the air bubble(s) in the return channel 33.

The protective substrate 13 has the rigidity which is higher than that of the channel substrate 11, and has the convex part 13*y* at the part thereof overlapping, in the vertical direction, with the return channel 33 (See FIG. 3). In this case, it is possible to easily realize the requirement that the height of the upper surface of the return channel 33 is higher than the upper surface of any one of the plurality of pressure chambers 20, for example, by performing further excavating the convex part 13*y* of the protective substrate 13.

The convex part 13*y* overlaps not only with the return channel 33 but also with the plurality of return connecting channels 26 in the vertical direction (see FIG. 3). In this case, if a part, of the convex part 13*y*, which overlaps with the plurality of return connecting channel 26 in the vertical direction is cut for the purpose of making the height of the upper surface of each of the plurality of return connecting channels 26 to be higher than the height of the upper surface of one of the pressure chamber 20 corresponding thereto, the rigidity of the protective substrate 13 is lowered. Consequently, in a case that a force is applied to the protective substrate 13 in a step of adhering the protective substrate 13 to the channel substrate 11, etc., the protective substrate 13 might be broken or damaged. In view of this situation, the present embodiment makes the height of the upper surface of each of the plurality of return connecting channels 26 to be same as the height of the upper surface of one of the pressure chambers 20 corresponding thereto, and thus there is no need to excessively perform cutting for the part, of the convex part 13*y*, overlapping with the plurality of return connecting channels 26 in the vertical direction, thereby making it possible to suppress any lowering in the rigidity of the protective substrate 13.

Each of the plurality of return connecting channel 26 extends in the oblique direction (the direction orthogonal to the vertical direction and crossing both of the first and second directions) (see FIG. 2). In this case, it is possible to make each of the return connecting channels 26 to be long, as compared with a case that each of the return connecting channels 26 extends in the second direction. This makes it possible to increase the resistance in each of the return connecting channels 26. With this, the flow rate of the ink inside each of the return connecting channels 26 is increased, thereby allowing any air bubble(s) inside the ink to flow smoothly.

The width W26 of each of the return connecting channels 26 is smaller than the width W20 of one of the pressure chambers 20 corresponding thereto (see FIG. 2). In this case, it is possible to increase the resistance in each of the return connecting channels 26, which in turn increases the flow rate of the ink inside each of the return connecting channels 26, and causes any air bubble(s) inside the ink to flow smoothly.

The head 1 is provided with the return damper film 33*d* defining the return channel 33 (see FIG. 3). In this case, it is possible to dampen or attenuate, in the return channel 33, a pressure wave generated when the ink is discharged from the nozzles 21, thereby realizing a stable discharge of the ink.

The area of the return damper film 33*d* is greater than the area of the first supply damper film 31*d* and greater than the area of the second supply damper film 32*d* (see FIG. 3). In this case, by providing, with respect to the one return channel 33, a damper film of which area is greater than the area of each of the two supply channels 31 and 32, it is possible to adjust the balance of the damping performance as the channels 31 to 33 as a whole, and to stabilize the discharge. In the present embodiment, in particular, the width of the return damper film 33*d* is greater than any of the width of the first supply damper film 31*d* and the width of the second supply damper film 32*d*. Since the magnitude of the width of a damper film greatly contributes to the damping performance of the damper film, it is possible to effectively adjust the balance of the damping performance(s) among the damper films.

The Young's module of the return damper film 33*d* is lower than any one of the Young's module of the first supply damper film 31*d* and the Young's module of the second supply damper film 32*d*. In the present embodiment, the return damper film 33*d* is formed of silicon, and the Young's module of the return damper film 33*d* is approximately 70 GPa. In contract, the first supply damper film 31*d* and the second supply damper film 32*d* are each formed of SUS, and the Young's module of each of the first and second supply damper films 31*d* and 32*d* is approximately 200 GPa. In this case, the Young's module of the return damper film 33*d* provided on the one return channel 33 is allowed to be low and thus makes the return damper film 33*d* to be easily bendable (flexible), thereby making it possible to adjust, in a more ensured manner, the balance of the damping performance(s) in the channels 31 to 33 as a whole.

The thickness of the return damper film 33*d* is smaller than any one of the thickness of the first supply damper film 31*d* and the thickness of the second supply damper film 32*d*. In this case, it is possible to easily realize the requirement that the Young's module of the return damper film 33*d* is low.

The return damper film 33*d* defines the lower surface of the return channel 33 (see FIG. 3). In this case, the return damper film 33*d* can be easily formed. In the present embodiment, for example, since the protective substrate 13, etc., are provided on the upper side of the return channel 33, it is difficult to provide the return damper film 33*d* on the upper side of the return channel 33. On the other hand, since the protective substrate 13, etc., are not provided on the lower side of the return channel 33, it is easy to provide the return damper film 33*d* on the lower side of the return channel 33, in coordination with the arrangement of the nozzle plates 11*d*1 and 11*d*2.

The nozzles 21 communicating respectively with the pressure chambers 20 belonging to the first pressure chamber group 20A, and the nozzles 21 communicating respectively with the pressure chambers 20 belonging to the second pressure chamber group 20 are individually formed in the two nozzle plates 11*d*1 and 11*d*2, respectively (see FIG. 3). The return damper film 33*d* is arranged between the two nozzle plates 11*d*1 and 11*d*2 in the second direction. In this case, it is possible to make the size as the nozzle plate as a whole be small and to reduce the material cost, as compared with, for example, such a case that a nozzle plate which has a shape with square-shaped opening wherein a through hole for arranging the return damper film 33*d* is formed in a central part thereof and in which all the plurality of nozzles 21 of the head 1 are formed. Further, by individually positioning the two nozzle plates 11*d*1 and 11*d*2, the positioning accuracy of the nozzles 21 is enhanced with an improved yield, as compared with a case of positioning one large nozzle plate.

The height of the lower surface of each of the plurality of return connecting channels 26 is higher than the height of the lower surface, of one of the plurality of pressure chambers 20, to which each of the plurality of return connecting channels 15 corresponds; and each of the plurality of nozzles 21 is provided on a part, in the lower surface of one of the plurality of pressure chambers 20, to which each of the plurality of nozzles 21 corresponds, the part in the lower surface being separated away from the one end in the second direction (one end to which one of the plurality of return connecting channels 26 is connected) in the lower surface of one of the plurality of pressure chambers 20 with which each of the plurality of nozzles 21 corresponds (see FIG. 3). In a case that the height of the lower surface of a certain return connecting channel 26 included in the return connecting channels 26 is higher than the height of the lower surface of a certain pressure chamber 20 which is included in the pressure chambers 20 and which corresponds to the certain return connecting channel 26, any stagnation might easily occur at the above-described one end in the lower surface of the certain pressure chamber 20. In view of this, by providing each of the nozzles 21 at the part separated away from the above-described one end (namely, avoiding the part at which any stagnation might easily occur), it is possible to obtain, in an ensured manner, the effect of preventing any incase in the viscosity of the ink inside each of the nozzles 21 which would have otherwise occurred due to the circulation.

Second Embodiment

Figure 5:
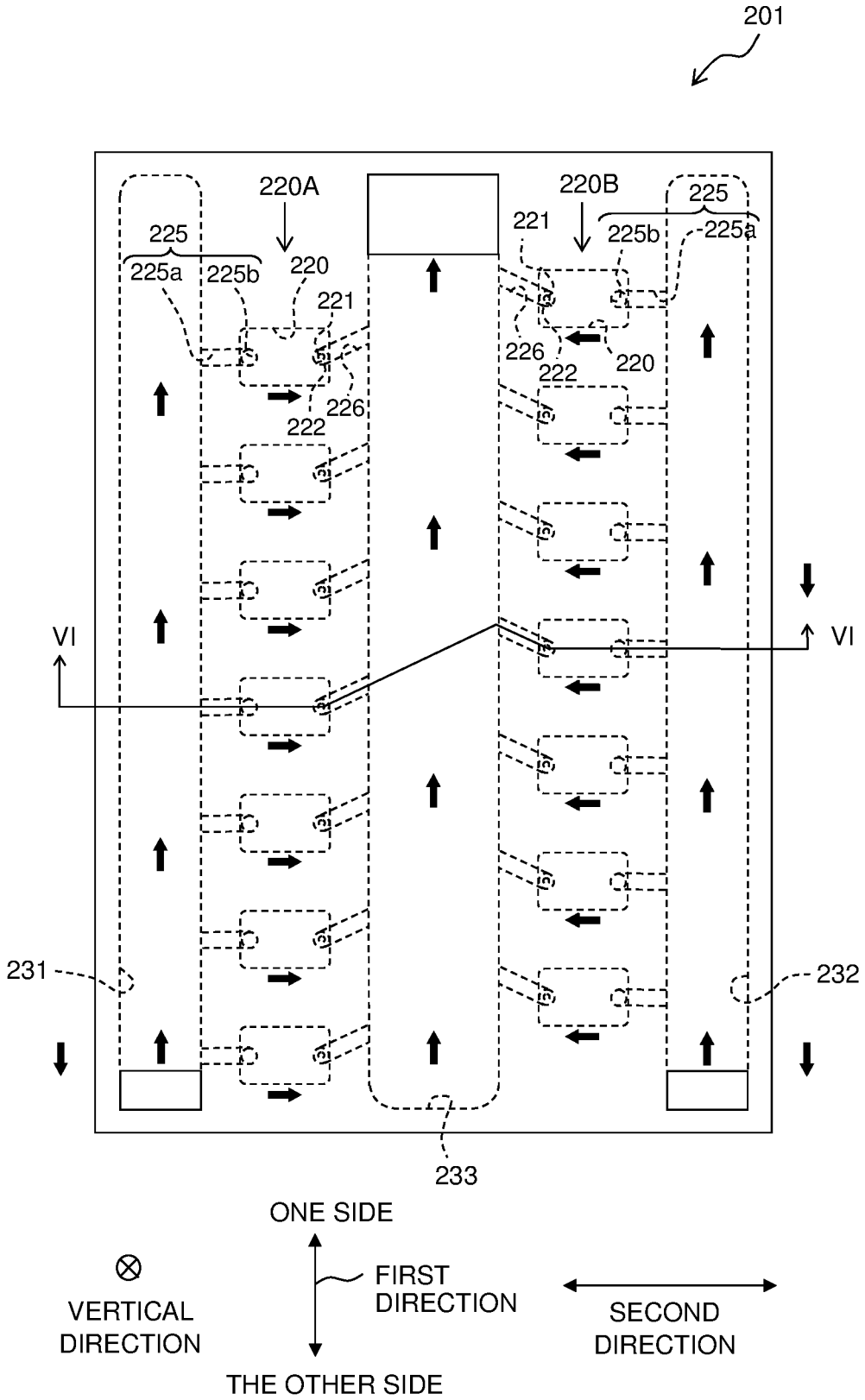
FIG. 5 is a plan view depicting a head 201.

Next, a head 201 according to a second embodiment of the present disclosure will be explained, with reference to FIGS. 5 and 6.

The second embodiment is different from the first embodiment in the configuration of the channels formed in the channel substrate.

In the following, only a part or portion, a configuration, etc., which are different from those of the first embodiment will be explained, whereas an explanation for a part, element or component of which configuration is similar to that in the first embodiment will be omitted.

Figure 6:
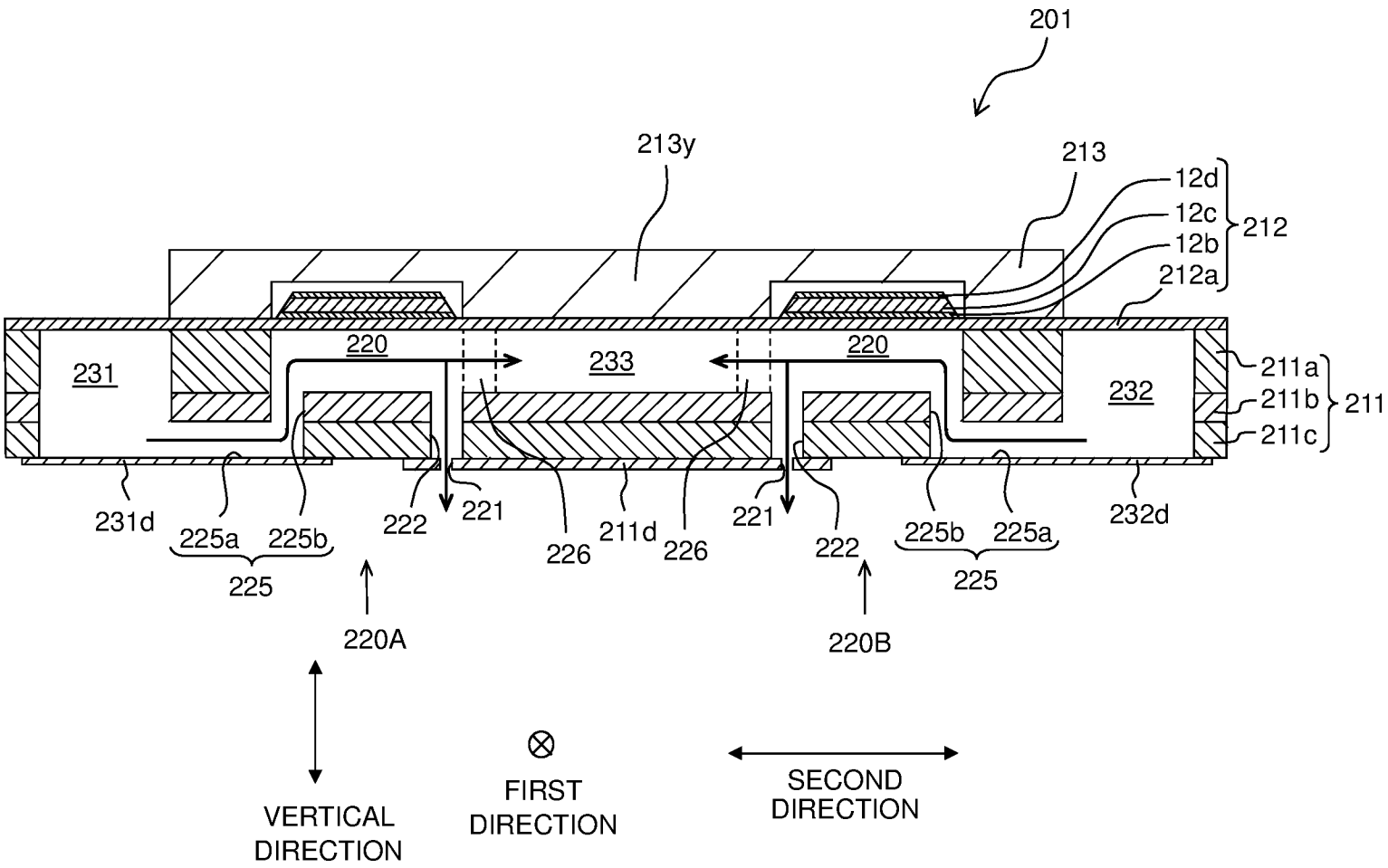
FIG. 6 is a cross-sectional view of the head 201, as taken along a VI-VI line in FIG. 5.

In the second embodiment, as depicted in FIG. 6, a channel substrate 211 is provided with a first supply channel 231, a second supply channel 232, a return channel 233, a plurality of pressure chambers 220, a plurality of supply connecting channels 225, a plurality of return connecting channels 226 and a plurality of nozzles 221, and further provided with a plurality of connecting channels 222.

Each of the plurality of connecting channels 222 extends downward from one end in the second direction of one of the plurality of pressure chambers 220, and connects one of the pressure chambers 220 and one of the plurality of nozzles 221 to each other. Each of the plurality of nozzles 221 is positioned immediately below one of the plurality of connecting channels 220, rather than immediately below one of the plurality of pressure chambers 220. Further, as depicted in FIG. 5, each of the plurality of nozzles 221 is provided on a central part in the first direction, of one of the plurality of pressure chambers 220, at one end in the second direction (one end to which one of the plurality of return connecting channels 226 is connected) of one of the plurality of pressure chambers 220, rather than to a substantially central part of one of the plurality of pressure chambers 220 in the plane orthogonal to the vertical direction.

As depicted in FIG. 6, each of the plurality of supply connecting channels 225 includes a horizontal part 225*a* connected to the first supply channel 231 or the second supply channel 232 and extending in a horizontal direction, and a vertical part 225*b* extending upward from a forward or tip end of the horizontal part 225*a* and connected to the other end in the second direction of one of the plurality of pressure chambers 220. The horizontal part 225*a* extends in the second direction.

An actuator substrate 212 has, in an order from the lower side, a vibration plate 212*a*, a common electrode 12*b*, a plurality of piezoelectric bodies 12*c* and a plurality of individual electrodes 12*d*, similarly to the actuator substrate 12 of the first embodiment. The protective substrate 213 has a convex part 213*y*, similarly to the protective substrate 13 of the first embodiment. Note, however, that in the convex part 213*y* and the vibration plate 212*a* of the second embodiment, parts thereof overlapping with the return channel 33 in the vertical direction are not subjected to the cutting.

The channel substrate 211 has three plates 211*a*, 211*b* and 211*c*, and one nozzle plate 211*d*. The three plates 211*a*, 211*b* and 211*c* are stacked on top of one another in the vertical direction. The nozzle plate 211*d* is adhered to the lower surface of the plate 211*c* which is the lowermost layer among the three plates 211*a*, 211*b* and 211*c*.

Each of the plurality of nozzles 221 is constructed of one of through holes formed in the nozzle plate 211*d*, and is open in the lower surface of the channel substrate 111. The nozzle plate 211*d* is formed with the plurality of nozzles 221 which correspond, respectively, to both of pressure chambers 20 included in the plurality of pressure chambers 20 and belonging to the first pressure chamber group 20A and pressure chambers 20 included in the plurality of pressure chambers 20 and belonging to the second pressure chamber group 20B.

The return channel 233 is constructed of a through hole formed in the plate 211*a*. The upper surface of the return channel 233 is defined by the vibration plate 212*a*. The lower surface of the return channel 233 is defined by the plate 211*b*. Any return damper film is not provided in the second embodiment.

Each of the first supply channel 231 and the second supply channel 232 is constructed of through holes formed in the plates 211*a*, 211*b* and 211*c*, respectively. The upper surfaces of the first supply channel 231 and the second supply channel 232 are defined by the vibration plate 212*a*. The bottom surface of the first supply channel 231 and the bottom surface of the second supply channel 232 are defined by a first supply damper film 231*d* and a second supply damper film 232*d*, respectively. The first supply damper film 231*d* and the second supply damper film 232*d* cover the entireties of the lower surfaces of the first supply channel 231 and the second supply channel 232, respectively, and sandwich the nozzle plate 211*d* therebetween in the second direction.

In the production step of the head 201, the nozzle plate 211*d* for which a high positional precision is required is firstly adhered to the lower surface of the plate 211*c*, and then the damper films 231*d* and 232*d* are adhered to the lower surface of the plate 211*c*.

Each of the plurality of pressure chambers 220 and each of the plurality of return connecting channels 226 are constructed of through holes, respectively, which are formed in the plate 211*a*. The upper surfaces of the pressure chambers 220 and the upper surfaces of the return connecting channels 226 are defined by the vibration plate 212*a*. The lower surfaces of the pressure chambers 220 and the lower surfaces of the return connecting channels 226 are defined by the plate 211*b*.

The horizontal part 225*a* of each of the plurality of supply connecting channels 225 is constructed of a through hole formed in the plate 211*c*. The vertical part 225*b* of each of the plurality of supply connecting channels 225 is constructed of a through hole formed in the plate 211*b*. The upper surface of the horizontal part 225*a* is defined by the plate 211*b*, and the lower surface of the horizontal part 225*a* is defined by the first supply damper film 231*d* or the second supply damper film 232*d*. Specifically, the lower surface of the horizontal part 225*a* connected to each of the pressure chambers 220 belonging to the first pressure chamber group 220A is defined by the first supply damper film 231*d*; the lower surface of the horizontal part 225*a* connected to each of the pressure chambers 220 belonging to the second pressure chamber group 220B is defined by the second supply damper film 232*d*.

Although the heights of the upper surfaces are changed from each of the supply channels 231 and 232 up to an outlet port of one of the supply connecting channels 225 (a connection part at which the supply connecting channel 225 is connected to the pressure chamber 220), the heights of the upper surfaces are constant from each of the pressure chambers 220 up to the return channel 233 via one of the return connecting channels 226. Namely, the height of the upper surface of each of the pressure chambers 220, the height of the upper surface of one of the return connecting channels 226, and the height of the upper surface of the return channel 233 are same to one another. Further, the depth (length in the vertical direction) of each of the pressure chamber 220, the depth of each of the return connecting channels 226 and the depth of the return channel 233 are same to one another; and the height of the lower surface of each of the pressure chamber 220, the height of the lower surface of each of the return connecting channels 226 and the height of the lower surface of the return channel 233 are same to one another, as well. The depth of each of the supply channels 231 and 232 is greater than the depth of one of the pressure chambers 220, the depth of one of the return connecting channels 226 and the depth of the return channel 233; and the height of the upper surface of each of the supply channels 231 and 232 is same as the height of the upper surface of one of the pressure chamber 220, the height of the upper surface one of the return connecting channels 226 and the height of the upper surface of the return channel 233; whereas the lower surface of each of the supply channels 231 and 232 is at a location lower than the lower surface of one of the pressure chambers 220, the lower surface of one of the return connecting channels 226 and the lower surface of the return channel 233.

In a case that the ink is circulated between the sub tank 7 (see FIG. 2) and the channel substrate 211 in the above-described channel configuration, the ink flows inside the channel substrate 211 in the following manner Bold arrows in FIGS. 5 and 6 indicate flow of the ink during the circulation.

The ink supplied to each of the supply channels 231 and 232 moves inside each of the supply channels 231 and 232 from one side (lower side in FIG. 5) to toward the other side (upper side in FIG. 5) of the first direction, while passing through each of the plurality of supply connecting channels 225 and flowing into one of the pressure chambers 220. A part or portion of the ink inflowed into each of the pressure chambers 220 passes through one of the plurality of connecting channels 222 and is discharged from one of the nozzles 221 and a remainder of the ink inflowed into each of the pressure chambers 220 passes through one of the plurality of return connecting channels 226 and flows into the return channel 233, as depicted in FIG. 6.

As described above, according to the second embodiment, the following effect can be obtained, in addition to the effect based on the configuration similar to that of the first embodiment.

The height of the upper surface of each of the pressure chambers 220, the height of the upper surface of each of the return connecting channel 226, the height of the upper surface of the return channel 33 are same to one another. In this case, the pressure chambers 220, the return connecting channels 226 and the return channel 233 can be formed in a same step. For example, in the second embodiment, the pressure chambers 220, the return connecting channels 226 and the return channel 233 can be formed by forming the vibration plate 212*a* in the upper surface of the plate 211*a*, then by forming the through holes constructing the pressure chambers 220, the return connecting channels 226 and the return channel 233, respectively, in the plate 211*a*, and then by adhering the plate 211*b* to the lower surface of the plate 211*a*, without requiring any other steps (the step of performing the cutting for forming the convex part 213*y*, etc.). In such a manner, the pressure chambers 220, the return connecting channels 226 and the return channel 233 can be formed easily.

The height of the lower surface of each of the return connecting channels 226 is same as the height of the lower surface of one of the pressure chambers 220 corresponding thereto (a pressure chamber 220 which is included in the plurality of pressure chambers 220 and to which each of the return connecting channels 226 is connected; or a pressure chamber 220 included in the plurality of pressure chambers 220 and which is connected to the return channel 233 by each of the plurality of return connecting channels 226). In a case that the height of the lower surface of a certain return connecting channel 226 which is included in the plurality of return connecting channels 226 is higher than the height of the lower surface of a certain pressure chamber 220 included in the plurality of pressure chambers 220 and which corresponds to the certain return connecting channel 226, any stagnation might easily occur at one end in the second direction (one end to which one of the return connecting channels 226 is connected) in the lower surface of the certain pressure chambers 220. This in turn might make it difficult to obtain the effect of preventing any increase in the viscosity of the ink and/or the agitation effect for any sediment component. For example, in a case that the ink contains a sediment component, such a sediment component might remain and sediment in the above-described one end in the lower surface of each of the pressure chambers 220. In view of this, in the second embodiment, there is not any stepped part or portion between the lower surface of each of the pressure chambers 220 and the lower surface of one of the return connecting channels 226, which in turn prevents any sedimentation of the sediment component from occurring. Thus, it is possible to obtain, in an ensured manner, the effect of preventing any incase in the viscosity of the ink and/or the agitation effect for any sediment component.

<Modifications>

Although the embodiments of the present disclosure have been explained in the foregoing, the present disclosure is not limited to or restricted by the above-described embodiments; it is allowable to make a various kind of design changes to the present disclosure, within the scope described in the claims.

It is allowable that the second direction crosses the first direction, and the second direction is not limited to being orthogonal to the first direction.

In the above-described embodiments, each of the first pressure chamber group and the second pressure chamber group is constructed of pressure chambers aligned in a row (array). It is allowable, however, that each of the first pressure chamber group and the second pressure chamber group is constructed of pressure chambers aligned in (so as to form) a plurality of rows.

In the above-described embodiments, the height of the upper surface of each of the return connecting channels is same as the height of the upper surface of one of the pressure chambers corresponding thereto (a pressure chamber which is included in the plurality of pressure chambers and to which each of the return connecting channels is connected or a pressure chamber included in the plurality of pressure chambers and which is connected to the return channel by each of the plurality of return connecting channels). It is allowable, however, that the height of the upper surface of each of the return connecting channels is higher that the height of the upper surface of one of the pressure chambers corresponding thereto. In such a case, although there is a stepped part or portion exists between the upper surface of each of the pressure chambers and the upper surface of one of the return connecting channels, any air bubble(s) flow smoothly from each of the pressure chambers toward one of the return connecting channels, without being caught at the stepped part.

In the above-described embodiment, although the two supply channels are provided with respect to the one return channel, it is allowable that one supply channel is provided with respect to one return channel.

The direction of flow of the liquid in the supply channel and the direction of the flow of the liquid in the return channel may be opposite (reverse) to each other. For example, in the above-described embodiment (see FIG. 2), the supply port 31*x*, the supply port 32*x* and the return port 33*x* may be formed respectively at one ends in the first direction of the respective channels 31 to 33.

The return damper film is not limited to or restricted by being defining the lower surface of the return channel, and may define, for example, the upper surface of the return channel, etc. Similarly, the supply damper film is not limited to or restricted by being defining the lower surface of the supply channel, and may define, for example, the upper surface of the supply channel, etc.

The return damper film and the supply damper film are not limited to being composed of a single member such as polyimide, etc., and may be composed of a composite material (for example, a composite material including a metal material defining the damper space and a polyimide member fixed to the metal material so as to close or seal the damper space).

The return damper film and the supply damper film may be composed of mutually different materials. In such a case, the requirement that the Young's module of the return damper film is lower than the Young's module of the supply damper film may be realized by the materials of the damper films, rather than by the thicknesses of the damper films.

Both of the return damper film and the supply damper film may be omitted.

Each of the return connecting channels is not limited to being extending in the oblique direction, and may extend in the second direction.

In the first embodiment, each of the nozzles 21 is provided on the central part in the second direction in the lower surface of one of the pressure chambers 20. It is allowable, however, that each of the nozzles 21 is provided on the other end in the second direction (an end which is opposite to the end to which one of the return connecting channels 26 is connected) in the lower surface of one of the pressure chambers 20.

In the first embodiment, the height of the upper surface of the return channel 33 is made to be high by performing the cutting for the convex part 13*y* of the protective substrate 13 and for the vibration plate 12*a*. The present disclosure, however, is not limited to this configuration. For example, it is allowable to perform the cutting only for the vibration plate 12*a*, without performing the cutting for the convex part 13*y* of the protective substrate 13.

The protective substrate may be omitted.

Although the number of the nozzle communicating with one pressure chamber is 1 (one) piece in the above-described embodiments, the number may be not less than 2 (two). Also, in the above-described embodiments, although one pressure chamber is provided with respect to one nozzle, it is allowable that two or more pressure chambers are provided with respect to one nozzle.

The actuator is not limited to being an actuator of the piezoelectric system using the piezoelectric element, and may be of another system (for example, of the thermal system using a heating device or element, of the electrostatic system using the electrostatic force, etc.).

The head is not limited to the line head, and may also be a serial head (head which is configured to discharge an ink from the nozzle toward a target or object of discharge, while moving in a scanning direction parallel to the paper width direction).

The object of the discharge is not limited to the paper (paper sheet) and may be, for example, cloth, a substrate, etc.

The liquid discharged from the nozzles is not limited to the ink, and may be any liquid (for example, a treatment liquid which causes a component in an ink to aggregate or deposit, etc.).

The present disclosure is not limited being applicable to the printer, and is applicable also to a facsimile machine, a copying machine, a multi-function peripheral, etc. Further, the present disclosure is also applicable to a liquid discharge apparatus which is usable for a usage which is different from performing recording of an image (for example, a liquid discharge apparatus which discharges a conductive liquid onto a substrate so as to form a conductive pattern on the substrate, etc.).

What is claimed is:

1. A liquid discharge head comprising:

a plurality of pressure chambers forming a first pressure chamber group and a second pressure chamber group, the first pressure chamber group including a part of the pressure chambers aligned in a first direction orthogonal to a vertical direction, and the second pressure chamber group including another part of the pressure chambers aligned in the first direction, the second pressure chamber group being arranged side by side relative to the first pressure chamber group in a second direction orthogonal to the vertical direction and crossing the first direction;

a return channel extending in the first direction between, in the second direction, the pressure chambers included in the first pressure chamber group and the pressure chambers included in the second pressure chamber group; and a plurality of return connecting channels each connecting the return channel and one of the plurality of pressure chambers to each other, wherein a height of an upper surface of each of the plurality of return connecting channels is not less than a maximum height of an upper surface of one of the plurality of pressure chambers which is connected to the return channel by each of the plurality of return connecting channels.

2. The liquid discharge head according to claim 1, wherein a height of an upper surface of the return channel is higher than the maximum height of the upper surface of any one of the plurality of pressure chambers.

3. The liquid discharge head according to claim 2, further comprising:

a channel substrate having the plurality of pressure chambers, the plurality of return connecting channels and the return channel;

an actuator substrate having a plurality of actuators each of which overlaps, in the vertical direction, with one of the plurality of pressure chambers, and fixed to the channel substrate; and a protective substrate which is arranged at a position at which the protective substrate sandwiches, in the vertical direction, the plurality of actuators between the channel substrate and the protective substrate, which covers the plurality of actuators, and which has a rigidity higher than a rigidity of the channel substrate, wherein the protective substrate has a concave part and a convex part, and the concave part is positioned at a part of the protective substrate overlapping, in the vertical direction, with the plurality of actuators, and the convex part is positioned at a part of the protective substrate overlapping, in the vertical direction, with the return channel.

4. The liquid discharge head according to claim 3, wherein the convex part overlaps, in the vertical direction, with the plurality of return connecting channels, and the height of the upper surface of each of the plurality of return connecting channels is the same as the maximum height of the upper surface of the one of the plurality of pressure chambers which is connected to the return channel by each of the plurality of return connecting channels.

5. The liquid discharge head according to claim 1, wherein the maximum height of the upper surface of each of the plurality of pressure chambers, the height of the upper surface of each of the plurality of return connecting channels and a height of an upper surface of the return channel are the same.

6. The liquid discharge head according to claim 1, wherein each of the plurality of return connecting channels extends in an oblique direction which is orthogonal to the vertical direction and which crosses with respect to both of the first and second directions.

7. The liquid discharge head according to claim 1, wherein a width of each of the plurality of return connecting channels is smaller than a width of one of the plurality of pressure chambers which is connected to the return channel by each of the plurality of return connecting channels.

8. The liquid discharge head according to claim 1, further comprising a return damper film defining the return channel.

9. The liquid discharge head according to claim 8, further comprising:

a first supply channel communicating with the pressure chambers included in the first pressure chamber group, and extending in the first direction;

a second supply channel communicating with the pressure chambers included in the second pressure chamber group, and extending in the first direction;

a first supply damper film defining a part of the first supply channel; and a second supply damper film defining a part of the second supply channel, wherein an area of the return damper film is greater than an area of the first supply damper film, and is greater than an area of the second supply damper film.

10. The liquid discharge head according to claim 9, wherein a Young's modulus of the return damper film is smaller than a Young's modulus of the first supply damper film and is smaller than a Young's modulus of the second supply damper film.

11. The liquid discharge head according to claim 10, wherein a thickness of the return damper film is smaller than a thickness of the first supply damper film and is smaller than a thickness of the second supply damper film.

12. The liquid discharge head according to claim 8, wherein the return damper film defines a lower surface of the return channel.

13. The liquid discharge head according to claim 12, further comprising:

a plurality of nozzles;

a first nozzle plate which is formed with nozzles included in the plurality of nozzles and communicating, respectively, with the pressure chambers belonging to the first pressure chamber group; and a second nozzle plate which is formed with nozzles included in the plurality of nozzles and communicating, respectively, with the pressure chambers belonging to the second pressure chamber group, which is separated from the first nozzle plate, and which sandwiches, in the second direction, the return damper film between the first nozzle plate and the second nozzle plate.

14. The liquid discharge head according to claim 13, wherein each of the plurality of return connecting channels is connected to an end in the second direction of one of the plurality of pressure chambers which is connected to the return channel by each of the plurality of return connecting channels;

a height of a lower surface of each of the plurality of return connecting channels is higher than a height of a lower surface, of one of the plurality of pressure chambers which is connected to the return channel by each of the plurality of return connecting channels; and each of the plurality of nozzles is provided on a part in the lower surface of one of the plurality of pressure chambers with which each of the plurality of nozzles is communicated, the part being separated away from the one end in the second direction of one of the plurality of pressure chambers.

15. The liquid discharge head according to claim 1, wherein a height of a lower surface of each of the plurality of return connecting channels is the same as a height of a lower surface of one of the plurality of pressure chambers which is connected to the return channel by each of the plurality of return connecting channels.

* * * * *